US006902516B2

(12) United States Patent
Krull

(10) Patent No.: US 6,902,516 B2
(45) Date of Patent: Jun. 7, 2005

(54) EXERCISE RESISTANCE METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 253 days.

(21) Appl. No.: 10/385,407

(22) Filed: Mar. 7, 2003

(65) Prior Publication Data

US 2003/0153439 A1 Aug. 14, 2003

Related U.S. Application Data

(62) Division of application No. 09/519,269, filed on Mar. 7, 2000, now Pat. No. 6,629,910, and a continuation-in-part of application No. 09/796,220, filed on Feb. 28, 2001, which is a continuation-in-part of application No. 09/519,269, filed on Mar. 7, 2000, which is a continuation of application No. 08/939,845, filed on Sep. 29, 1997, now Pat. No. 6,033,350.

(51) Int. Cl.[7] ..... A63B 21/062
(52) U.S. Cl. ..... 482/98; 482/99
(58) Field of Search ..... 482/93, 94, 97–103, 482/908

(56) References Cited

U.S. PATENT DOCUMENTS

| | | | | | |
|---|---|---|---|---|---|
| 4,349,192 | A | * | 9/1982 | Lambert, Jr. et al. | 482/101 |
| 4,529,198 | A | | 7/1985 | Hettick, Jr. | |
| 4,538,805 | A | | 9/1985 | Parviainen | |
| 4,627,615 | A | * | 12/1986 | Nurkowski | 482/98 |
| 4,712,793 | A | * | 12/1987 | Harwick et al. | 482/99 |
| 4,834,365 | A | * | 5/1989 | Jones | 482/100 |
| 5,135,453 | A | * | 8/1992 | Sollenberger | 482/101 |
| 5,776,040 | A | * | 7/1998 | Webb et al. | 482/98 |
| 5,779,604 | A | | 7/1998 | Towley, III | |
| 6,033,350 | A | * | 3/2000 | Krull | 482/98 |
| 6,582,345 | B2 | * | 6/2003 | Roy | 482/98 |
| 6,629,910 | B1 | * | 10/2003 | Krull | 482/98 |
| 6,719,672 | B1 | * | 4/2004 | Ellis et al. | 482/99 |
| 6,733,424 | B2 | * | 5/2004 | Krull | 482/98 |

FOREIGN PATENT DOCUMENTS

| | | | | |
|---|---|---|---|---|
| AU | 200126494 | A * | 5/2001 | A63B/21/06 |
| DE | 2004006399 | U1 * | 7/2004 | A63B/21/062 |
| FR | 22613237 | A1 * | 10/1988 | A63B/21/062 |
| JP | 410118222 | A | 5/1998 | |

* cited by examiner

*Primary Examiner*—Justine R. Yu
*Assistant Examiner*—Victor K. Hwang

(57) ABSTRACT

An exercise apparatus includes a vertical stack of weights, including a top plate, and at least one additional weight disposed adjacent the top plate. The additional weight may be a plate having a height, a width, and a thickness that is smaller than the width and smaller than the height, and arranged so that its thickness extends horizontally toward the stack of weights, and/or multiple additional weights may be arranged to define a horizontal array on at least one side of the stack of weights. The additional weight(s) may be movably mounted on the frame for movement along a path defined by interfaces between opposite outer surfaces of the weight(s) and respective guide surfaces on the frame. A selector rod may be movably mounted on the top plate for movement into and out of engagement with one or more of the additional weights, and/or arranged to define a longitudinal axis that extends through all of the additional weights and perpendicular to the stack of weights. A user operated member may be rotatably mounted on the top plate and linked to the selector rod.

20 Claims, 8 Drawing Sheets

Fig. 3
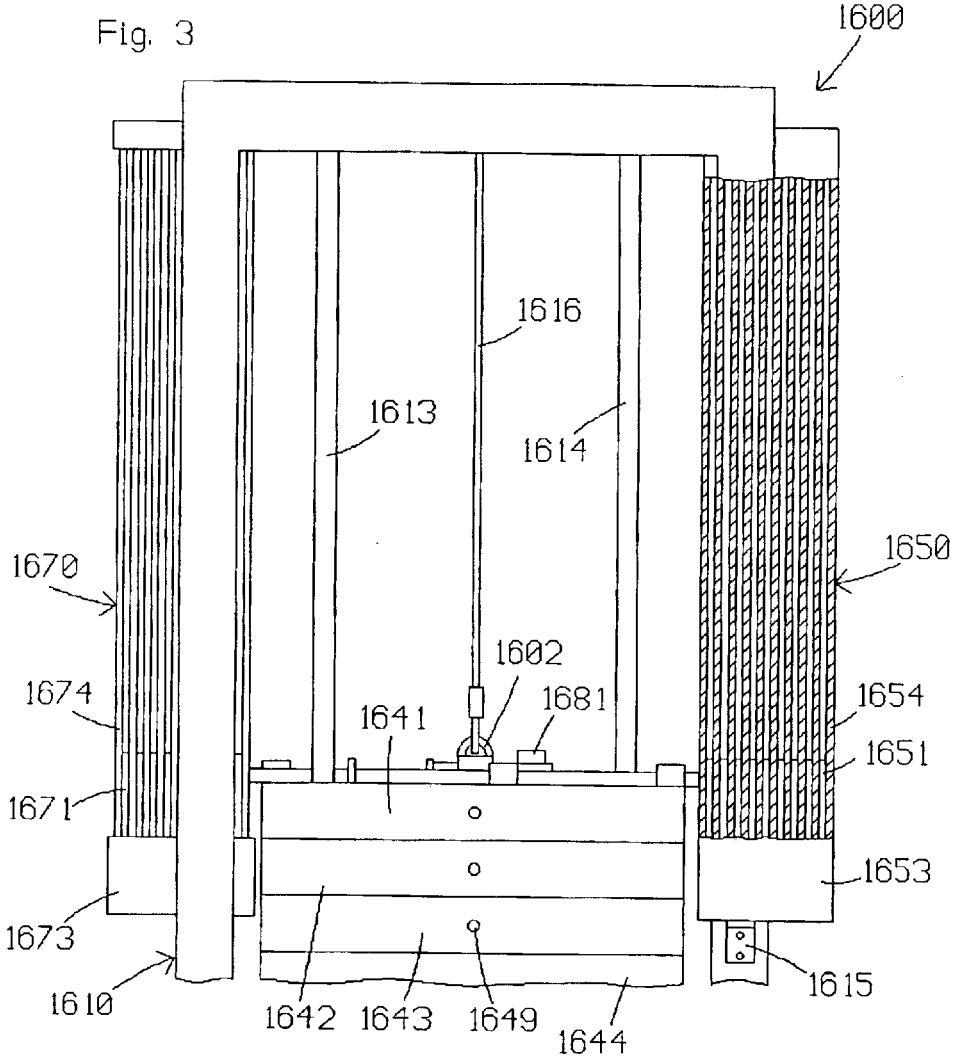
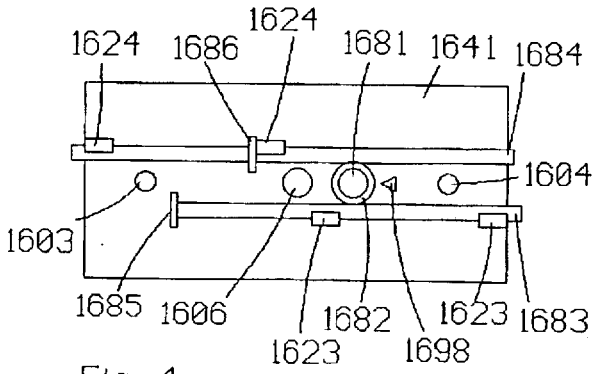
Fig. 4

Fig. 5
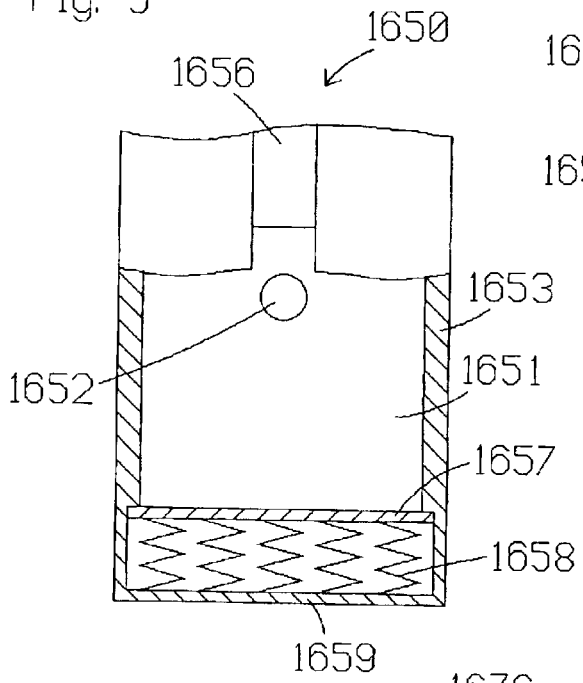
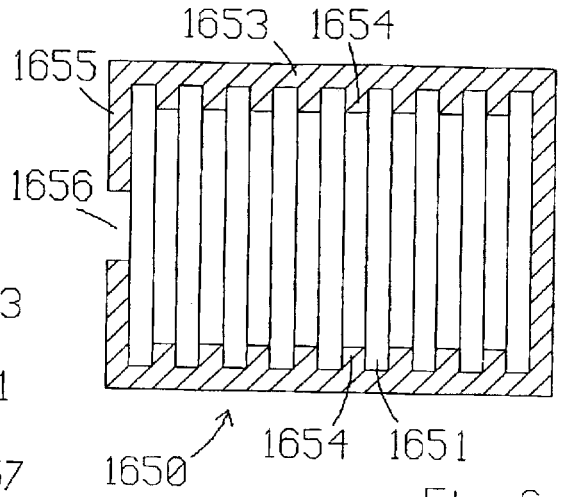
Fig. 6
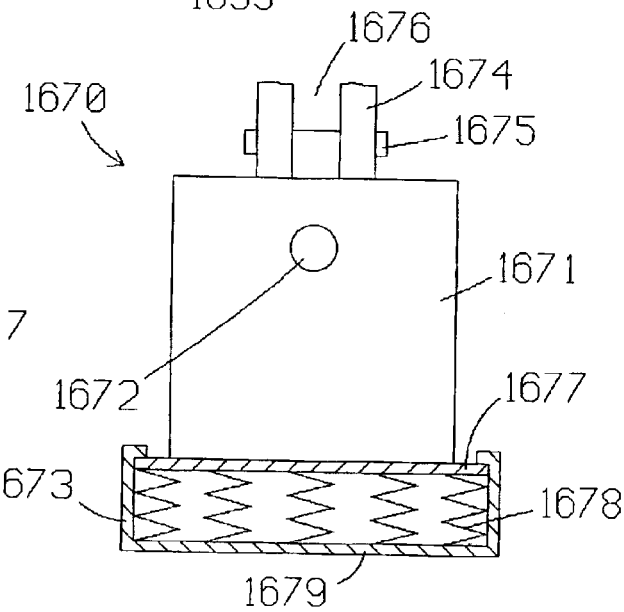
Fig. 7
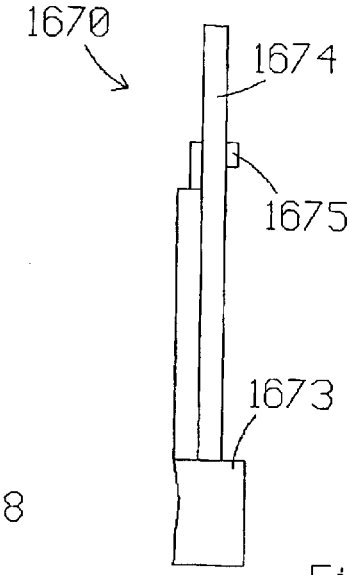
Fig. 8

Fig. 9
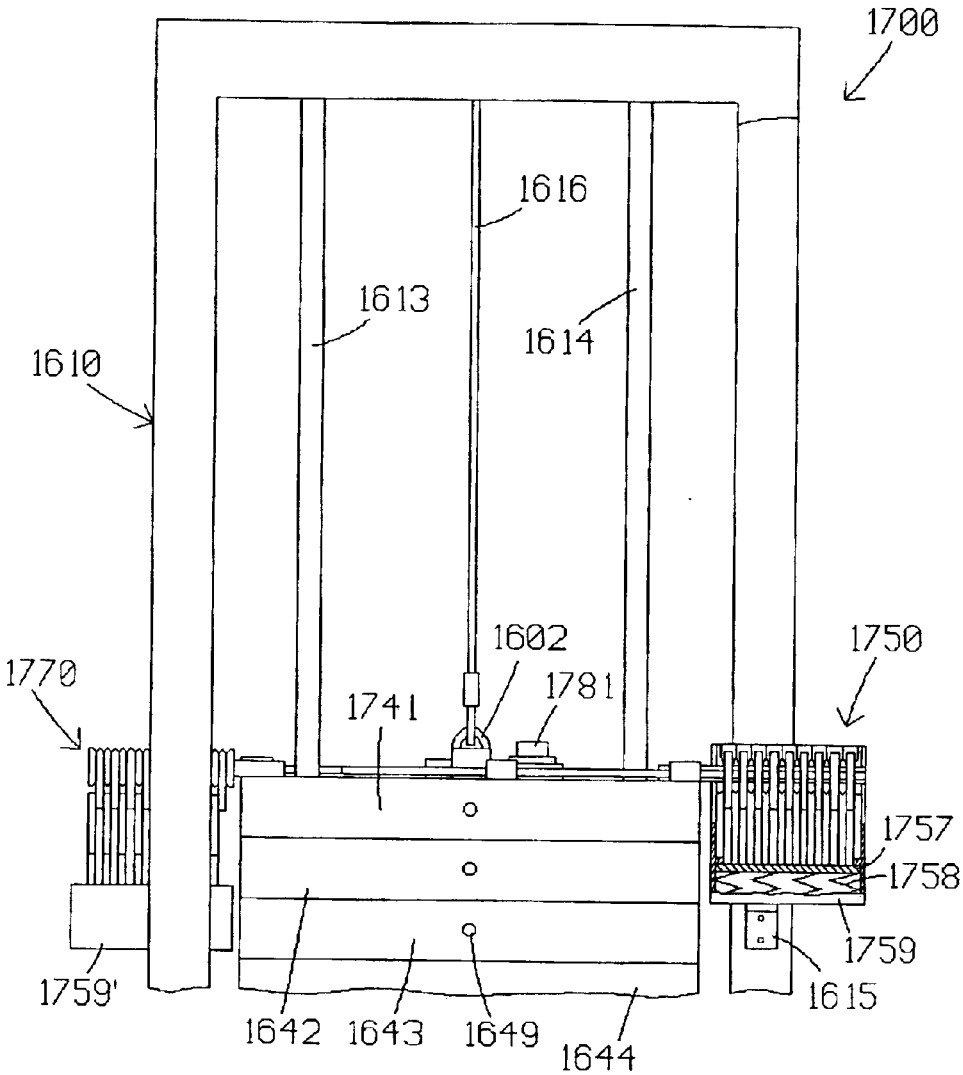
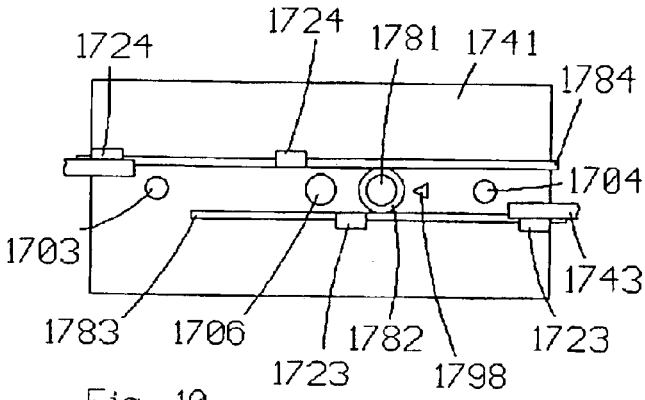
Fig. 10

Fig. 11
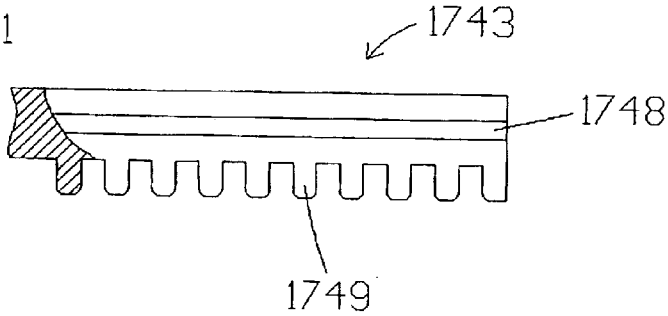
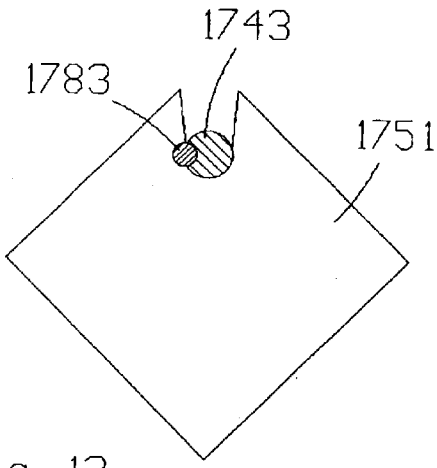
Fig. 13
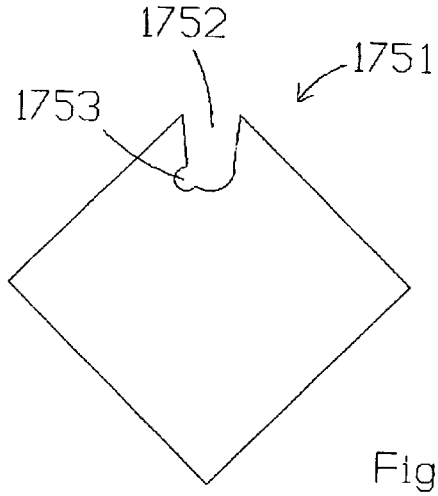
Fig. 12
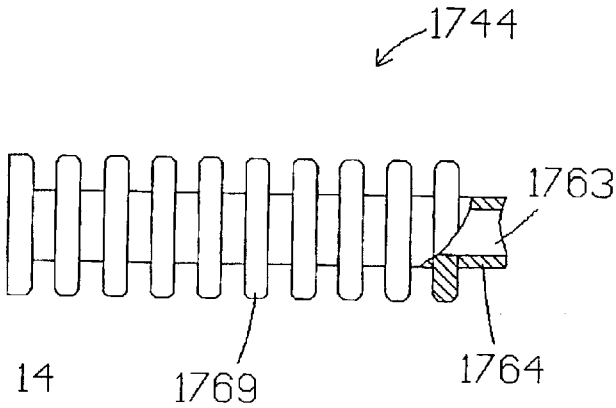
Fig. 14

EXERCISE RESISTANCE METHODS AND APPARATUS

CROSS-REFERENCE TO RELATED APPLICATIONS

This application is (1) a divisional of U.S. patent application Ser. No. 09/519,269, filed on Mar. 7, 2000, now U.S. Pat. No. 6,629,910, which in turn, is a continuation of U.S. patent application Ser. No. 08/939,845, filed on Sep. 29, 1997 (U.S. Pat. No. 6,033,350); and (2) a continuation-in-part of U.S. patent application Ser. No. 09/796,220, filed on Feb. 28, 2001, which in turn, is a continuation-in-part of U.S. patent application Ser. No. 09/519,269, filed on Mar. 7, 2000, which in turn, is a continuation of U.S. patent application Ser. No. 08/939,845, filed on Sep. 29, 1997 (U.S. Pat. No. 6,033,350).

FIELD OF THE INVENTION

The present invention relates to exercise methods and apparatus and more particularly, to weight-based resistance to exercise movement.

BACKGROUND OF THE INVENTION

Various weight selection methods and apparatus have been developed to provide adjustable resistance to exercise. For example, exercise weight stacks are well known in the art and prevalent in the exercise equipment industry. Generally speaking, a plurality of weights or plates are arranged in a vertical stack and maintained in alignment by guide members or rods. A desired amount of weight is engaged by selectively connecting a selector rod to the desired weight in the stack. The selector rod and/or the uppermost weight in the stack are/is connected to at least one force receiving member by means of a connector. The engaged weight is lifted up from the stack in response to movement of the force receiving member.

U.S. Pat. No. 4,538,805 to Parviainen discloses a weight stack machine having a stack of primary weights, and first and second supplementary weights disposed on opposite sides of the primary weights and interconnected by a bar. The combined weight of the supplementary weights is equal to the combined weight of the stack. First and second lock pin assemblies are movably mounted on respective supplemental weights for selective movement into engagement with respective sides of the top plate in the stack.

Japan Patent No. JP410118222A to Ozawa et al. discloses a weight stack machine having a stack of primary weights, and first and second stacks of secondary weights disposed on opposite sides of the primary weights. Each secondary weight appears to weigh a fraction of each primary weight. First and second selector pins are selectively inserted through desired holes in respective sides of the uppermost primary weight to selectively engage a desired number of respective secondary weights.

Exercise barbells and dumbbells are another type of weight lifting equipment that is well known in the art and prevalent in the exercise equipment industry. Generally speaking, these devices include a handle and a desired amount of weight or number of weight plates secured to opposite ends of the handle. The device is lifted up subject to gravitational force acting on the mass of the handle and attached weights. On relatively advanced devices, the bar is stored in proximity to the weight plates, and a selection mechanism is provided to connect a desired amount of weight to the bar.

U.S. Pat. No. 4,529,198 to Hettick, Jr. discloses a barbell assembly having a handle, and first and second weight boxes connected to respective, opposite ends of the handle. A base maintains first and second sets of weights in alignment with respective weight boxes. First and second flexible springs are inserted through respective boxes and through a desired number of respective weights to determine the weight to be lifted.

U.S. Pat. No. 5,779,604 to Towley, III et al. discloses a dumbbell assembly having a handle, and a plurality of interconnected opposite end weights that are stored in nested relationship to one another and the handle. One or more pins may be inserted radially or axially through the handle and a desired number of weights to determine the weight to be lifted. The dumbbell assemblies are also shown mounted on opposite sides of the top plate in a weight stack.

Despite the foregoing advances and others in the field of weight selection, room for improvement remains.

SUMMARY OF THE INVENTION

Generally speaking, the present invention involves the selection of a variable amount of weight for purposes of resisting exercise movement. On a preferred embodiment, the available weight includes a top plate and underlying primary weights, and at least one additional weight disposed laterally adjacent the top plate.

According to one aspect of the present invention, the additional weight is a plate having a height, a width, and a thickness that is smaller than the width and smaller than the height, and the plate is disposed adjacent the top plate and arranged so that its thickness extends horizontally toward the stack of weights. Also, a selector rod is movably mounted on the top plate for movement between a first position disposed outside a planform defined by the plate, and a second position underlying at least a portion of the plate.

According to another aspect of the present invention, multiple additional weights are arranged to define a horizontal array on at least one side of the top plate. A selector rod is movably mounted on the top plate for movement into and out of engagement with more than one of the additional weights.

According to yet another aspect of the present invention, a first selector rod is configured and arranged to selectively engage the primary weights, and it defines a longitudinal axis that extends through the primary weights. Also, multiple additional weights are movably mounted on the frame, and a second selector rod is configured and arranged to selectively engage the additional weights. The second selector rod defines a longitudinal axis that extends through the additional weights and perpendicular to the longitudinal axis of the first selector rod.

According to still another aspect of the present invention, a user operated member is rotatably mounted on the top plate and linked to a selector rod that is movable into and out of engagement with the additional weight.

According to a further aspect of the present invention, the additional weight has a thickness defined between opposite outer surfaces, and is movably mounted on the frame for movement along a path defined by interfaces between the outer surfaces and respective guide surfaces on the frame. A selector rod is movably mounted on the top plate for movement between a first position disposed outside a planform defined by the additional weight, and a second position underlying at least a portion of the additional weight.

Many of the features and advantages of the present invention, as well as combinations of the foregoing features, will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the several views.

FIG. 3 is a partially sectioned, front view of an exercise weight stack constructed according to the principles of the present invention;

FIG. 4 is a top view of a top plate on the weight stack of FIG. 3;

FIG. 5 is a partially sectioned, end view of a first supplemental weight assembly on the weight stack of FIG. 3;

FIG. 6 is a partially sectioned, top view of the weight assembly of FIG. 5;

FIG. 7 is a partially sectioned, end view of a second supplemental weight assembly on the weight stack of FIG. 3;

FIG. 8 is a more detailed front view of part of the weight assembly of FIG. 7;

FIG. 9 is a partially sectioned, front view of another exercise weight stack constructed according to the principles of the present invention;

FIG. 10 is a top view of a top plate on the weight stack of FIG. 9;

FIG. 11 is a partially sectioned, front view of a part of a first supplemental weight assembly on the weight stack of FIG. 9;

FIG. 12 is an end view of another part of the first supplemental weight assembly on the weight stack of FIG. 9;

FIG. 13 is a partially sectioned, end view of the parts of FIGS. 11 and 12 keyed together;

FIG. 14 is a partially sectioned, front view of a part of a second supplemental weight assembly on the weight stack of FIG. 9;

DETAILED DESCRIPTION OF A PREFERRED EMBODIMENT

The present invention provides methods and apparatus which facilitate exercise involving the movement of weights subject to gravitational force. Generally speaking, the present invention allows a person to adjust weight resistance by moving one or more selector rods into engagement with a desired number of weights. The present invention may be applied to exercise weight stacks and/or free weight assemblies such as dumbbells.

Figure 1:
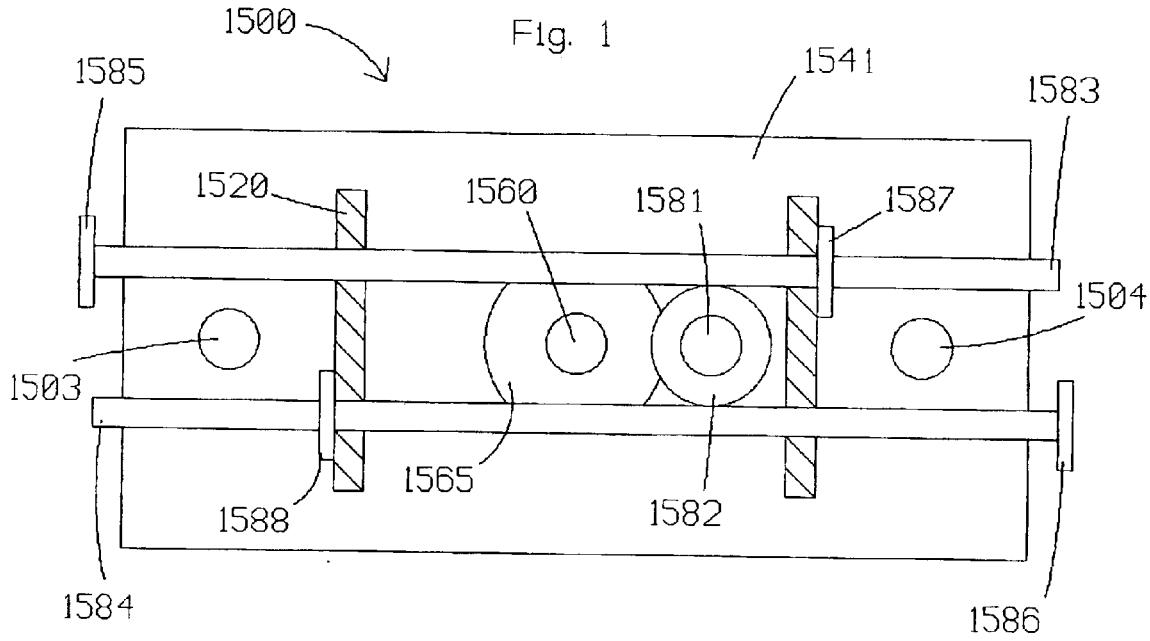
FIG. 1 is a top view of a top weight stack plate constructed according to the principles of the present invention.
Figure 2:
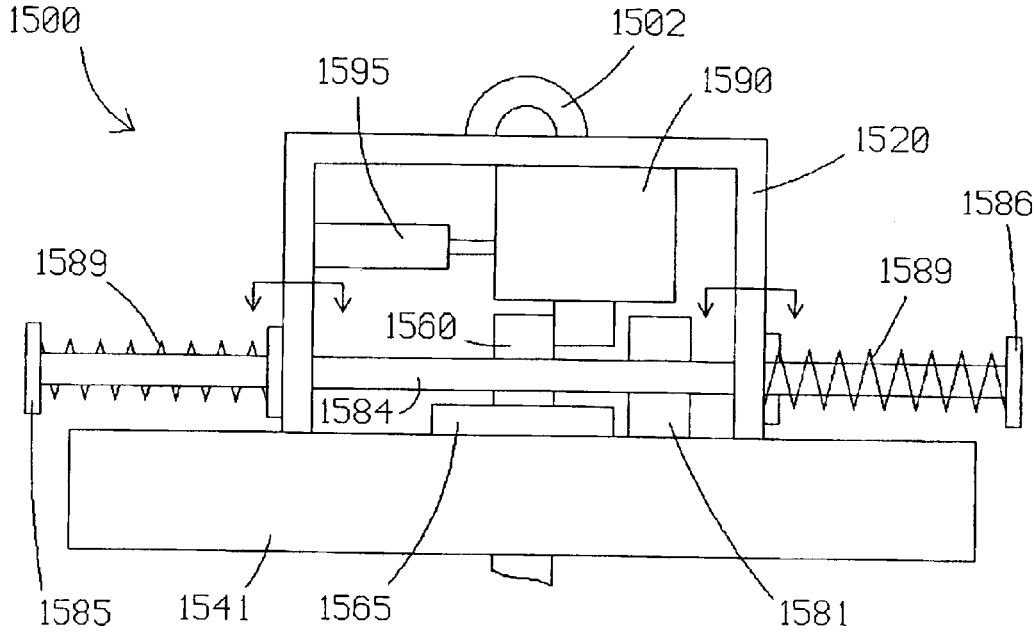
FIG. 2 is a front view of the top weight stack plate of FIG. 1.

FIGS. 1–2 show an assembly 1500 constructed according to the principles of the present invention. The assembly 1500 includes a base member or plate 1541 which is sized and configured to function as the top plate in a weight stack. Holes 1503 and 1504 are formed through the plate 1541 and cooperate with guide rods in a manner known in the art. A central hole is formed through the plate 1541 to receive a selector rod 1560 constructed according to the principles of the present invention. A disc 1565 cooperates with another disc (disposed within a cavity in the plate 1541) to rotatably mount the selector rod 1560 to the plate 1541. As explained in U.S. Pat. No. 5,876,313 to Krull, which is incorporated herein by reference, the selector rod 1560 (or a suitable alternative) is selectively rotatable into and out of engagement with weights stacked beneath the plate 1541.

A bracket 1520 is rigidly mounted on the plate 1541 and spans a substantial portion thereof. A catch 1502 is rigidly mounted on top of the bracket 1520 and connects to a force transmitting cable in a manner known in the art. Holes are formed through opposite walls of the bracket 1520 to receive and support first and second selector rods 1583 and 1584. As explained below with reference to FIGS. 3–21, the rods 1583 and 1584 (or suitable alternatives) are selectively movable into and out of engagement with weights disposed on opposite sides of the plate 1541.

An optional motor 1590 is movably connected to the bracket 1520 and operable to selectively drive the selector rod 1560 and the rods 1583 and 1584. A linear actuator 1595, or other suitable member, is interconnected between the bracket 1520 and the motor 1590 and operable to move the latter relative to the former. When the actuator 1595 is relatively retracted, an output shaft on the motor 1590 engages or bears against the selector rod 1560. When the motor 1590 occupies this first position relative to the plate 1541, operation of the motor 1590 results in rotation of the selector rod 1560.

When the actuator 1595 is relatively extended, the output shaft on the motor 1590 disengages the selector rod 1560 and engages or bears against a first portion 1581 of an idler wheel which is rotatably mounted on the plate 1541. When the motor occupies this second position relative to the plate 1541, operation of the motor 1590 results in rotation of the idler wheel. A second, discrete portion 1582 of the idler wheel engages or bears against each of the rods 1583 and 1584, so that rotation of the idler wheel relative to the plate 1541 causes the rods 1583 and 1584 to move in opposite directions relative to the plate 1541. Those skilled in the art will recognize that compatible gear teeth may be disposed on the interengaging portions of the output shaft, the selector rod 1560, the idler wheel portions 1581 and 1582, and the rods 1583 and 1584, in order to facilitate the transfer of motion therebetween.

On a preferred embodiment, the underlying weights are relatively heavy (e.g. thirty pounds each), and the opposite side weights are relatively light (e.g. three pounds each). The provision of six thirty-pound weights beneath the top plate and four three-pound weights to each side of the top plate, together with a thirty pound top plate, provides resistance to exercise which (i) ranges from thirty pounds to two hundred and thirty-four pounds and (ii) is adjustable in three or six pound increments (depending on whether opposite side weights are engaged in pairs or individually). In the event that a counterweight is provided to offset the weight of the top plate, the same weights would provide resistance to exercise ranging from zero pounds to two hundred and four pounds.

One way to select a desired amount of weight will be described with reference to the foregoing collection of weights and a motorized version of the present invention. In such a scenario, data indicating a desired amount of weight is entered into a controller via a keypad, a machine readable card, a voice recognition device, a switch on a force receiving member, or any other suitable means. The controller compares the desired amount of weight to the currently selected amount of weight. If the two values are equal (or within the minimum available adjustment of one another), then the controller simply indicates that the desired amount of weight is engaged. Otherwise, the controller divides the desired amount of weight by the larger weight increment (thirty) to obtain a quotient. The controller then rounds down the quotient to obtain a first integer value and determines whether the selector rod should be rotated. If so, then the controller moves the motor output shaft into engagement with the selector rod and rotates the selector rod to engage the appropriate number of underlying weights. Thereafter, the controller subtracts the first integer value from the quotient to obtain a remainder and divides the remainder by the smaller weight increment (three). The controller then rounds off to obtain a second integer value and determines whether the rods should be moved. If so, then the controller moves the motor output shaft into engagement with the idler wheel and moves the rods into engagement with the appropriate number of opposite side weights. After any and all adjustments have been made, the controller indicates that the desired amount of weight is engaged.

In FIG. 2, the selector rods 1583 and 1584 are shown with optional heads 1585 and 1586, stops 1587 and 1588, springs 1589. The springs 1589 cooperate with the bracket 1520 and respective heads 1585 and 1586 to bias respective rods 1583 and 1584 toward retracted (or disengaged) positions relative to their respective side weights. The stops 1587 and 1588 cooperate with the bracket 1520 to limit travel of respective rods 1583 and 1584 in the "retracted" direction. Recognizing that the springs 1589 are operable to move the rods 1583 and 1584 in the opposite direction, and that the selector rod 1560 can be rotated beyond a full revolution with no adverse effect, an advantage of this "biased" arrangement is that the motor is required to operate in only a single direction, so long as its output shaft resists rotation and remains engaged with the idler wheel during exercise.

FIGS. 3–21 and 22 show various ways to selectively engage weights disposed on opposite sides of a base member or top plate. FIGS. 3–21 demonstrate several methods with reference to weight stacks, and FIG. 22 demonstrates a method with reference to dumbbells. Those skilled in the art will recognize that the features of the various embodiments may be mixed and matched to arrive at additional embodiments and/or selection processes.

As shown in FIG. 3, an exercise weight stack 1600 generally includes a frame 1610, a base member 1641, weights 1642–1644 underlying the base member 1641, and weights 1651 and 1671 disposed on opposite sides of the base member 1641. Holes 1603 and 1604 are formed through the base member 1641 (and through the weights 1642–1644) to accommodate respective guide rods 1613 and 1614. Another hole 1606 is formed through the base member 1641 (and through the weights 1642–1644) to accommodate a selector rod of the type known in the art and rigidly secured to the top plate 1641. Transverse holes are formed through the selector rod and align with transverse holes 1649 through the weights 1642–1644 to accommodate a selector pin. One end of a cable 1616 is connected to the selector rod by means of a catch 1602. An opposite end of the cable 1616 is connected to a force receiving member (not shown).

A knob 1681 and a gear 1682 are mounted on the base member 1641 and rotate together about a common axis of rotation relative to the base member 1641. Diametrically opposed portions of the gear 1682 engage respective rods 1683 and 1684 which are movably mounted on the base member 1641 by means of respective supports 1623 and 1624. Gear teeth are provided on the rods 1683 and 1684 to engage the teeth on the gear 1682 in such a manner that rotation of the latter causes the former to move in opposite directions relative to the base member 1641. Stops 1685 and 1686 are provided on respective rods 1683 and 1684 to limit their travel relative to the base member 1641. An indicator 1698 is provided on the base member 1641 to cooperate with indicia on the knob 1681 and/or the gear 1682 to indicate the orientation of both relative to the base member 1641.

The rod 1683 is movable into engagement with weights 1651 disposed in a first supplemental weight assembly 1650 which is mounted on the frame 1610 to the right of the base member 1641 (as shown in FIG. 3). Brackets 1615 rigidly connect upper and lower ends of the weight assembly 1650 to the frame 1610.

Portions of the weight assembly 1650 are shown in greater detail in FIGS. 5–6. The weights 1651 are disposed between opposite sidewalls 1653 and spaced apart from one another by inwardly extending projections 1654. In other words, the projections 1654 and the sidewalls 1653 cooperate to define channels which constrain the weights 1651 to move through a particular path. A front wall 1655 faces the base member 1641 and provides a slot 1656 to accommodate travel of the selector rod 1683 through the same particular path as the weights 1651.

The weights 1651 are supported from below by a shock absorbing platform 1657 which is movably mounted between the sidewalls 1653. A bottom wall 1659 is rigidly secured between the sidewalls 1653, and springs 1658 are compressed between the bottom wall 1659 and the platform 1657. The springs 1658 bias the platform 1657 upward against shoulders projecting inward from the sidewalls 1653. A hole 1652 is formed through each weight 1651 to receive the selector rod 1683 when both the base member 1641 and the weights 1651 are at rest. The shock absorbing platform 1657 is provided to accommodate downward impact which might occur at the conclusion of an exercise stroke.

Those skilled in the art will recognize that the assembly 1650 holds the weights 1651 in place prior to selection; keeps the weights 1651 spaced apart to ensure proper selection; supports the weights 1651 during exercise motion; and returns the weights 1651 to their proper location at the conclusion of exercise motion.

The other rod 1684 is movable into engagement with weights 1671 disposed in a second supplemental weight assembly 1670 which is mounted on the frame 1610 to the left of the base member 1641 (as shown in FIG. 3). The weight assembly 1670 may be connected to the frame 1610 by brackets 1615 or any other suitable means.

Portions of the weight assembly 1670 are shown in greater detail in FIGS. 7–8. A plastic guide member 1675 is rigidly secured to each of the weights 1671 by screws or other suitable means. Each guide member 1675 is sized and configured to travel between a pair of rails or strips 1674 which extend substantially from the top to the bottom of the assembly 1670. Whether rigid or merely taut, the rails 1674 cooperate with the guide members 1675 to constrain the weights 1671 to move through a bounded path.

Each pair of rails 1674 defines a slot 1676 therebetween to accommodate a respective guide member 1675 and the selector rod 1684. An intermediate portion of the guide member 1675 rides within the slot 1676, and upper, distal portions of the guide member 1675 are disposed on a side of the rails 1674 opposite the weight 1671.

As in the first assembly 1650, the weights 1671 in the assembly 1670 are supported from below by a shock absorbing platform 1677 which is movably mounted between opposing sidewalls 1673. A bottom wall 1679 is rigidly secured between the sidewalls 1673, and springs 1678 are compressed between the bottom wall 1679 and the platform 1677. The springs 1678 bias the platform 1677 upward against flanges projecting inward from the sidewalls 1673. A hole 1672 is formed through each weight 1671 to receive the selector rod 1673 when both the base member 1641 and the weights 1671 are at rest. The shock absorbing platform 1677 accommodates downward impact which might occur at the end of an exercise stroke.

Those skilled in the art will recognize that the assembly 1670 holds the weights 1671 in place prior to selection; keeps the weights 1671 spaced apart to ensure proper selection; supports the weights 1671 during exercise motion; and returns the weights 1671 to their proper location at the conclusion of exercise motion. Those skilled in the art will also recognize that no significance should be attributed to the depiction of both assemblies 1650 and 1670 on a single machine and/or without motorized adjustment and/or without a rotating selector rod. All such combinations are clearly within the scope of the present invention.

FIGS. 9–18 show two additional ways to selectively engage weights disposed on opposite sides of a base member or top plate. As shown in FIG. 9, an exercise weight stack 1700 generally includes a frame 1610, a base member 1741, weights 1642–1644 underlying the base member 1741, and weight assemblies 1750 and 1770 disposed on opposite sides of the base member 1741. Holes 1703 and 1704 are formed through the base member 1741 (and through the weights 1642–1644) to accommodate respective guide rods 1613 and 1614. Another hole 1706 is formed through the base member 1741 (and through the weights 1642–1644) to accommodate a selector rod of the type known in the art and fastened to the top plate 1741. Transverse holes are formed through the selector rod and align with transverse holes 1649 through the weights 1642–1644 to accommodate a selector pin. One end of a cable 1616 is connected to the selector rod by means of a catch 1602. An opposite end of the cable 1616 is connected to a force receiving member.

A knob 1781 and a gear 1782 are mounted on the base member 1741 and rotate together about a common axis of rotation relative to the base member 1741. Diametrically opposed portions of the gear 1782 engage respective rods 1783 and 1784 which are movably mounted on the base member 1741 by means of respective supports 1723 and 1724. Gear teeth are provided on the rods 1783 and 1784 to engage the teeth on the gear 1782 in such a manner that rotation of the latter causes the former to move in opposite directions relative to the base member 1741. In lieu of the stops on the previous embodiments, the gear teeth are disposed only on discrete portions of the rods 1783 and 1784 so as to limit travel of the rods 1783 and 1784 relative to the base member 1741. An indicator 1798 is provided on the base member 1741 to cooperate with indicia on the knob 1781 and/or the gear 1782 to indicate the orientation of both relative to the base member 1741.

On the right side of the apparatus 1700, a bar 1743 is rigidly secured to the base member 1741 and spans the weight assembly 1750. As shown in FIG. 11, a groove 1748 extends the length of the bar 1743, and fingers 1749 project downward from the bar 1743. The profile of the groove 1748 has a radius of curvature comparable to that of the rod 1783. As shown in FIG. 12, an upwardly opening slot 1752 is formed in each weight 1751 in the assembly 1750 to accommodate the bar 1743. The fingers 1749 on the bar 1743 insert between the weights 1751 to maintain proper spacing therebetween. A notch 1753 is formed in each weight 1751 proximate the lower end of the slot 1752. The notch 1753 has a radius of curvature comparable to that of the groove 1748 and cooperates therewith to define a keyway sized and configured to receive the rod 1783, as shown in FIG. 13.

The supplemental weight assembly 1750 is mounted on the frame 1610 to the right of the base member 1741 (as shown in FIG. 9). Brackets 1615 rigidly connect the opposite sides of the bottom of the weight assembly 1750 to the frame 1610. When everything is at rest, the bar 1743 occupies the position shown in FIG. 13 relative to the weights 1751, and the rod 1783 is movable through the keyway and into the engagement with the weights 1751.

Figure 19:
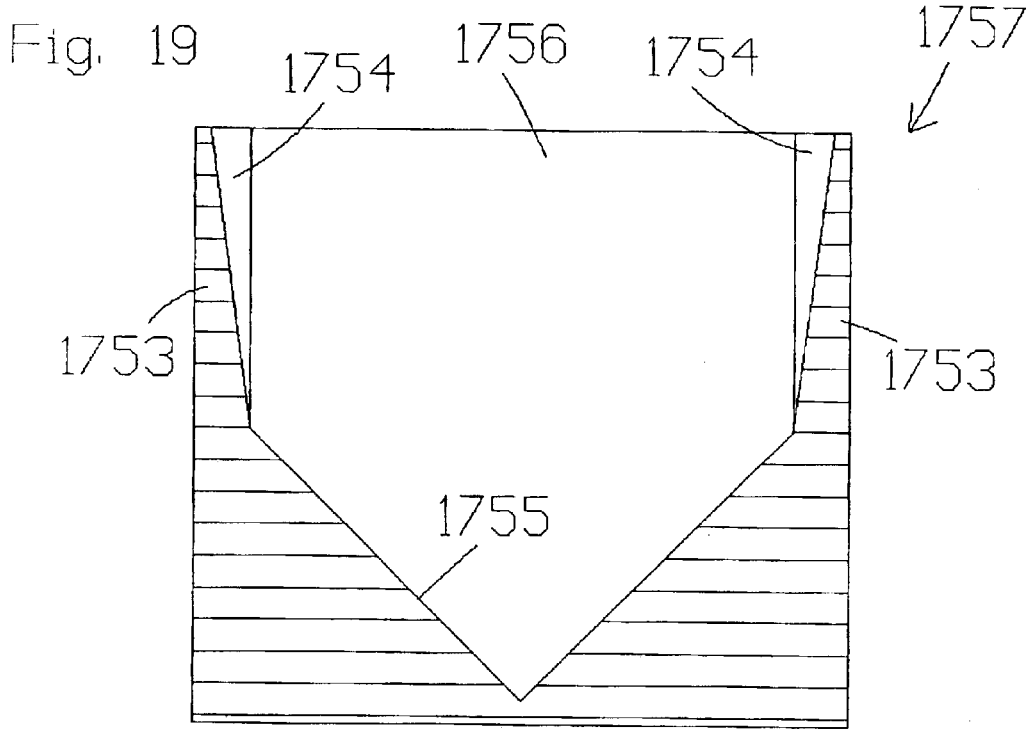
FIG. 19 is an end view of yet another part of the weight stack of FIG. 9.

The weights 1751 are disposed in a box 1757 which is shown in greater detail in FIG. 19. The box 1757 has opposing sidewalls 1753, which may be described as inwardly converging. The sidewalls 1753 form junctures with opposing base walls 1755, which may be described as more severely inwardly converging. Notches in the sidewalls 1753 are bounded by notch walls 1754 which may also be described as inwardly converging (though with respect to planes extending parallel to the drawing sheet for FIG. 19, as opposed to a single plane extending perpendicular thereto). The sidewalls 1753, the notch walls 1754, and the base walls 1755 are configured to guide the weights 1751 back into their proper positions or slots 1756 within the box 1757.

The box 1757 is movably mounted within a housing 1759 and is supported from below by shock absorbing springs 1758. The springs 1758 are disposed between the bottom wall of the box 1757 and the bottom wall of the housing 1759. The springs 1758 bias the box 1757 upward against pegs which project inward from the end walls of the box 1757. The shock absorbing springs 1658 are provided to accommodate downward impact which might occur at the conclusion of an exercise stroke.

Those skilled in the art will recognize that the assembly 1750 holds the weights 1751 in place prior to selection; keeps the weights 1751 spaced apart to ensure proper selection; supports the weights 1751 during exercise motion; and returns the weights 1751 to their proper location at the conclusion of exercise motion. Additional advantages of this embodiment 1750 include the elimination of guides extending along the weights' path of travel, and the ability to use a relatively smaller diameter selector rod (in combination with the bar).

Figure 15:
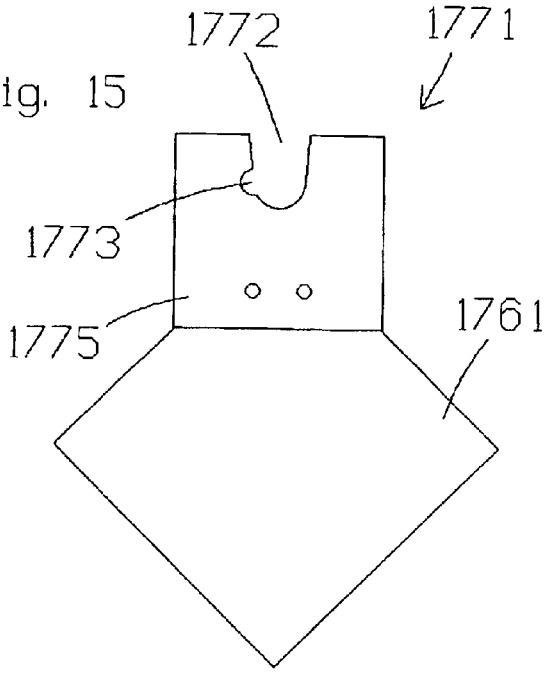
FIG. 15 is an end view of another part of the second supplemental weight assembly on the weight stack of FIG. 9.
Figure 16:
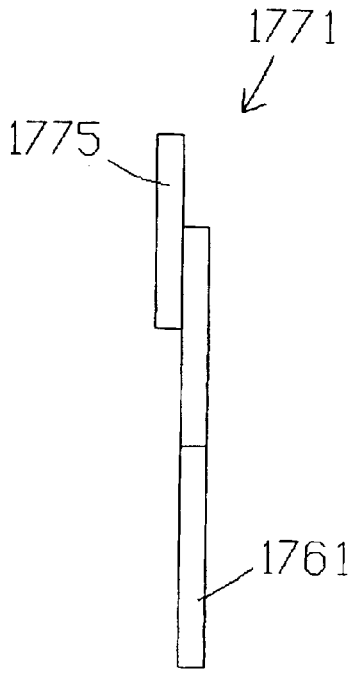
FIG. 16 is a more detailed front view of the part of FIG. 15.

On the other side of the apparatus 1700, a bar 1744 is rigidly secured to the base member 1741 and spans the weight assembly 1770. As shown in FIG. 14, the bar 1744 includes a solid steel shaft 1763 inserted into a plastic sleeve 1764. A groove (not shown) extends the length of the bar 1744, and relatively large diameter rings 1769 project radially outward from the sleeve 1764. The profile of the groove has a radius of curvature comparable to that of the rod 1784. As shown in FIG. 15, each weight 1771 includes a relatively high mass member 1761 secured to a guide member 1775 by screws or other fasteners. An upwardly opening slot 1772 is formed in each guide member 1775 to accommodate the bar 1744. The rings 1769 on the bar 1744 insert between the guide members 1775 to maintain proper spacing between the weights 1771. A notch 1773 is formed in each guide member 1775 proximate the lower end of the slot 1772. The notch 1773 has a radius of curvature comparable to that of the groove and cooperates therewith to define a keyway sized and configured to receive the rod 1784 (in a manner similar to that shown in FIG. 13).

The supplemental weight assembly 1770 is mounted on the frame 1610 to the left of the base member 1741 (as shown in FIG. 9). Brackets 1615 rigidly connect the opposite sides of the bottom of the weight assembly 1770 to the frame 1610. When everything is at rest, the bar 1744 occupies the bottom portion of each slot 1757, and the rod 1784 is movable through the resulting keyways and into the engagement with the weights 1771. The assembly also includes a housing 1759' which is functionally similar to that on the assembly 1750.

Those skilled in the art will recognize that the assembly 1770 holds the weights 1771 in place prior to selection; keeps the weights 1771 spaced apart to ensure proper selection; supports the weights 1771 during exercise motion; and returns the weights 1771 to their proper location at the conclusion of exercise motion; and further, requires a relatively smaller diameter selector rod (in combination with the bar), and does not require guides extending along the weights' path of travel. Moreover, the assembly 1770 uses injection molded parts to eliminate milling procedures which might otherwise be required during manufacture.

Figure 17:
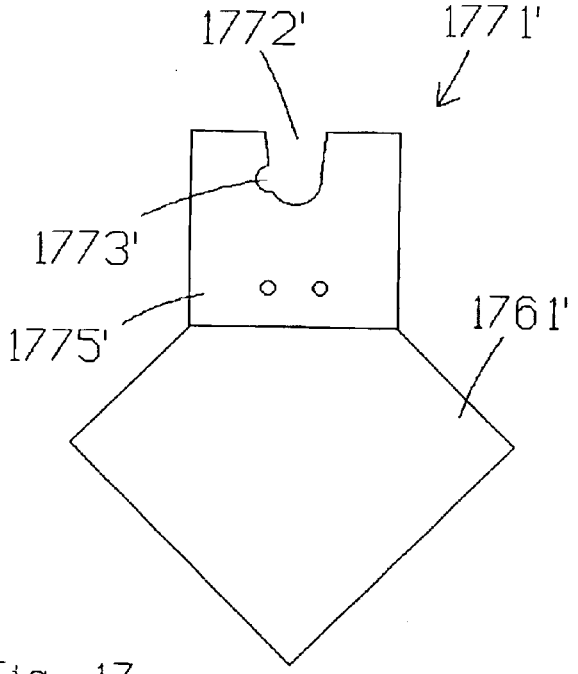
FIG. 17 is an end view of a suitable alternative for the part of FIG. 15.
Figure 18:
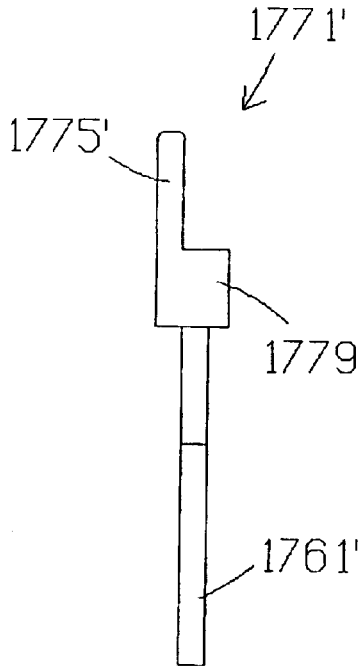
FIG. 18 is a front view of the part of FIG. 17.

An alternative weight 1771', which is suitable for use in the assembly 1770, is shown in FIGS. 17–18. Like the previous weight 1771, the weight 1771' includes a relatively high mass member 1761 connected to a guide member 1775' by screws or other suitable means. Like the previous guide member 1775, the guide member 1775' includes a slot 1772' to accommodate the bar 1744 and a notch 1773' to accommodate the rod 1784. However, the guide member 1775' provides a shoulder or spacer 1779 on an opposite side of the high mass member 1761 and cooperates with counterparts on adjacent weights to establish the effective spacing of the weights 1771'.

Figure 20:
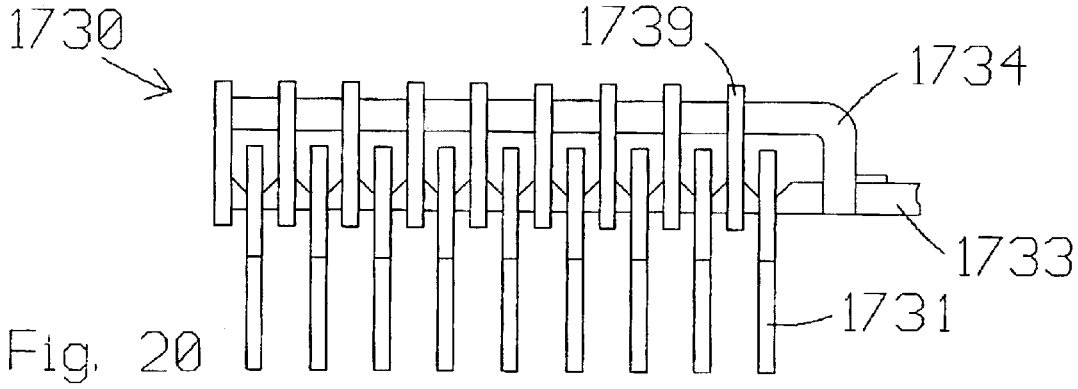
FIG. 20 is a front view of another supplemental weight assembly suitable for use on an exercise weight stack.
Figure 21:
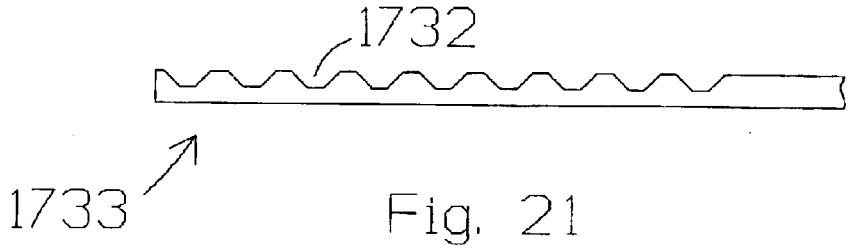
FIG. 21 is a front view of a part of the weight assembly of FIG. 20.

An alternative bar and rod combination is designated as 1730 in FIGS. 20–21. The assembly 1730 includes a bar 1734 of the type which may be rigidly secured to the base member 1741 in place of the bar 1744, for example. Downwardly projecting tabs 1739 are secured to the bar 1734 at spaced locations along the longitudinal axis thereof. Holes are formed through the tabs 1739 to receive a rod 1733 of the type which may be movably mounted to the base member 1741 in place of the rod 1784, for example. Upwardly opening notches 1732 are formed in the rod 1733 at spaced locations along the longitudinal axis thereof.

Weights 1731, which are similar in overall shape to the weights 1751, are maintained at spaced intervals in a housing similar to that designated as 1759 in FIG. 9. A hole is formed through each weight 1731 to receive the selector rod 1733. Advantages of this particular arrangement of parts include that the weights 1731 are encouraged to rest within respective notches 1732 when engaged by the selector rod 1733, and that the bar 1734 contributes to the structural integrity of the rod 1733. Those skilled in the art will also recognize that this assembly 1730, as well as the others described herein, may include weights of other sizes and/or shapes.

Figure 22:
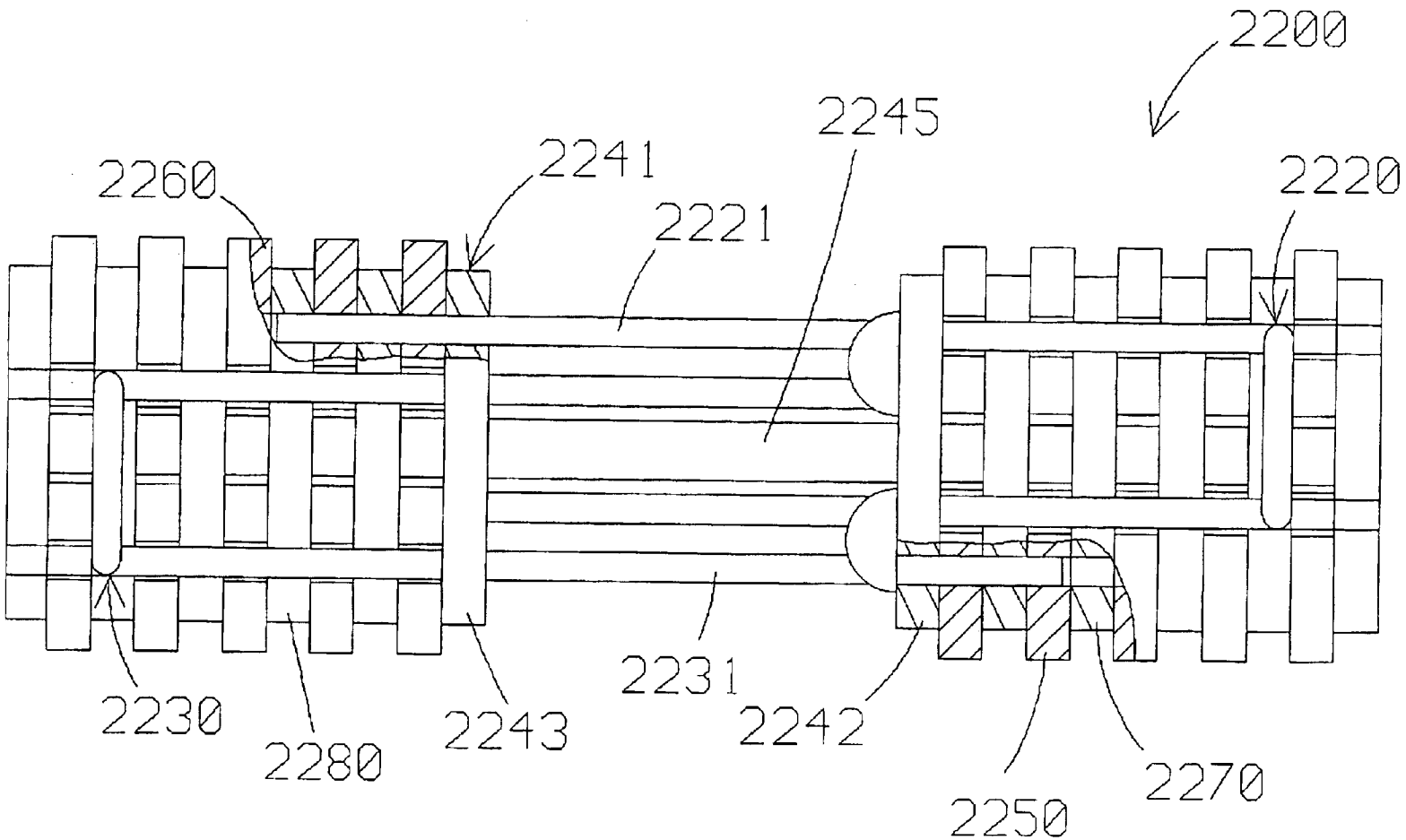
FIG. 22 is a partially sectioned, top view of an exercise dumbbell constructed according to the principles of the present invention.

FIG. 22 shows a dumbbell 2200 that operates in a manner described in U.S. Pat. No. 6,033,350 to Krull, which is incorporated herein by reference. Generally speaking, the dumbbell 2200 has relatively wide spacers 2270 disposed between weights 2250, and relatively wide spacers 2280 disposed between weights 2260, which provide a relatively large margin for error for positioning of prongs 2221 and 2231 on respective selector rods 2220 and 2230. In fact, the widths of the spacers 2270 and 2280 is sufficient to allow the selector rods 2220 and 2230 to be out of phase, so to speak. In particular, each revolution of the pinion gear (not shown) causes only one of the selector rods 2220 or 2230 to engage an additional weight 2260 or 2250, while the other selector rod moves into engagement with the next spacer 2280 or 2270. For example, the assembly 2200 is shown in FIG. 22 to have engaged two weights on each side of the base 2241. One more turn of the pinion gear will cause the selector rod 2220 to engage a third weight 2260, and the selector rod 2230 to engage a second spacer 2270. Such an arrangement allows twice as many weight adjustments, or in other words, weight adjustments in increments one-half as great, for a given number of weights on the assembly 2200.

Those skilled in the art will recognize that features of the present invention may be implemented in different ways and/or combinations to arrive at additional embodiments and/or methods. Recognizing that those skilled in the art are likely to derive various additional embodiments and/or improvement from this disclosure, the scope of the present invention should be limited only to the extent of the following claims.

What is claimed is:

1. An exercise apparatus, comprising:

a frame adapted to rest on a floor surface;

a top plate and a plurality of first weights arranged into a vertical stack and movably mounted on the frame for movement along a path defined by the frame;

at least one second weight configured as a plate having a height, a width, and a thickness that is smaller than the width and smaller than the height, wherein the at least one second weight is disposed adjacent the top plate movably mounted on the frame, and arranged so that its thickness extends horizontally toward the stack; and a selector rod movably mounted on the top plate for movement between a first position disposed outside a planform defined by the at least one second weight, and a second position underlying at least a portion of the at least one second weight.

2. The exercise apparatus of claim 1, wherein the at least one second weight includes two second weights disposed horizontally adjacent one another.

3. The exercise apparatus of claim 2, wherein the selector rod is movable to the second position to underlie only one of the second weights, and the selector rod is movable to a third position underlying both of the second weights.

4. The exercise apparatus of claim 1, wherein the thickness is measured between opposite outer surfaces of the plate, and the outer surfaces are configured and arranged to contact respective guide members on the frame.

5. The exercise apparatus of claim 1, further comprising a user operated member rotatably mounted on the top plate and linked to the selector rod, wherein rotation of the user operated member in a first direction causes the selector rod to move to the first position, and rotation of the user operated member in an opposite, second direction causes the selector rod to move to the second position.

6. The exercise apparatus of claim 1, wherein each said second weight weighs less than each of the first weights.

7. An exercise apparatus, comprising:

a frame adapted to rest on a floor surface;

a top plate and a plurality of primary weights arranged into a vertical stack and movably mounted on the frame for movement along a path defined by the frame;

a first selector rod configured and arranged to selectively engage the primary weights;

a plurality of supplemental weights arranged into a horizontal array on at least one side of the primary weights and movably mounted on the frame; and at least one second selector rod movably mounted on the top plate for movement into and out of engagement with more than one of the supplemental weights.

8. The exercise apparatus of claim 7, wherein each of the supplemental weights weighs less than each of the primary weights.

9. The exercise apparatus of claim 7, wherein a user operated member is rotatably mounted on the top plate and linked to the at least one second selector rod.

10. The exercise apparatus of claim 9, wherein rotation of the user operated member in a first rotational direction is linked to linear movement of the at least one second selector rod in a first horizontal direction, and rotation of the user operated member in an opposite, second rotational direction is linked to linear movement of the at least one selector rod in an opposite, second horizontal direction.

11. An exercise apparatus, comprising:

a frame adapted to rest on a floor surface;

a top plate and a plurality of first weights arranged into a stack and movably mounted on the frame for movement along a first path defined by the frame;

a first selector rod configured and arranged to selectively engage the first weights, and to define a longitudinal axis that extends through all of the first weights;

a plurality of second weights movably mounted on the frame; and a second selector rod movably mounted on the top plate, and configured and arranged to selectively engage the second weights, and to define a longitudinal axis that extends through all of the second weights and perpendicular to the longitudinal axis of the first selector rod.

12. The exercise apparatus of claim 11, wherein a user operated member is rotatably mounted on the top plate and linked to the second selector rod.

13. The exercise apparatus of claim 12, wherein rotation of the user operated member in a first direction is linked to movement of the second selector rod into engagement with relatively more of the second weights, and rotation of the user operated member in an opposite, second direction is linked to movement of the second selector rod into engagement with relatively fewer of the second weights.

14. The exercise apparatus of claim 11, wherein the second weights are movably mounted on the frame for movement parallel to the path of the first weights.

15. The exercise apparatus of claim 14, wherein the first selector rod extends parallel to the path.

16. The exercise apparatus of claim 14, wherein the second selector rod extends perpendicular to the path.

17. The exercise apparatus of claim 11, wherein each of the second weights weighs less than each of the first weights.

18. An exercise apparatus, comprising:

a frame adapted to rest on a floor surface;

a top plate and a plurality of primary weights arranged into a vertical stack and movably mounted on the frame for movement along a path defined by the frame;

at least one supplemental weight disposed adjacent the vertical stack and movably mounted on the frame;

a selector rod movably mounted on the top plate for movement into and out of engagement with the at least one supplemental weight; and a user operated member rotatably mounted on the top plate and linked to the selector rod.

19. An exercise apparatus, comprising:

a frame adapted to rest on a floor surface;

a top plate and a plurality of first weights arranged into a vertical stack and movably mounted on the frame for movement along a first path defined by the frame;

at least one second weight having a thickness defined between opposite outer surfaces, wherein the at least one second weight is movably mounted on the frame for movement along a second path defined by interfaces between the outer surfaces and respective guide surfaces on the frame; and a selector rod movably mounted on the top plate for movement between a first position disposed outside a planform defined by the at least one second weight, and a second position underlying at least a portion of the at least one second weight.

20. The exercise apparatus of claim 19, wherein a shock absorbing platform is mounted on the frame to define a lower end of the second path.

* * * * *